US005889447A

United States Patent [19]

Newell et al.

[11] Patent Number: 5,889,447

[45] Date of Patent: Mar. 30, 1999

[54] CERAMIC FILTER WITH BEVELED SURFACE

[75] Inventors: Michael Newell, Placitas; Steven S. Kear, Albuquerque, both of N. Mex.

[73] Assignee: Motorola Inc., Schaumburg, Ill.

[21] Appl. No.: 621,044

[22] Filed: Mar. 22, 1996

[51] Int. Cl.[6] ..... H01P 2/01

[52] U.S. Cl. ..... 333/202; 333/206

[58] Field of Search ..... 333/203, 206, 333/222, 202, 202 DB

[56] References Cited

U.S. PATENT DOCUMENTS

| | | | |
|---|---|---|---|
| 5,327,109 | 7/1994 | Hoang et al. | 333/206 |
| 5,436,602 | 7/1995 | McVeety et al. | 333/206 |

FOREIGN PATENT DOCUMENTS

| | | | |
|---|---|---|---|
| 4061501 | 2/1992 | Japan | 333/202 DB |
| 6069702 | 3/1994 | Japan | 333/206 |

*Primary Examiner*—Benny Lee

*Attorney, Agent, or Firm*—Gary J. Cunningham

[57] ABSTRACT

A ceramic block filter (100), having a substantially rectangular block of ceramic material having a top (102), bottom (104), and four side surfaces (106, 108, 110 and 112), and having through-holes (114) running from the top (102) to the bottom surfaces (104); a metallization layer coating on substantially an entire exterior portion of the block and the through-holes (114), with the exception of a part of the top surface (102) of the block being unmetallized; the top surface (102) being beveled at an acute angle with respect to one of the side surfaces of the ceramic block; and coupling input-outputs for providing an input and output for filtering signals.

16 Claims, 7 Drawing Sheets

CERAMIC FILTER WITH BEVELED SURFACE

FIELD OF THE INVENTION

This invention relates to ceramic block filters, and particularly to a ceramic filter with an beveled surface.

BACKGROUND OF THE INVENTION

The use of dielectric ceramic block filters to remove undesirable electrical frequencies from an electrical signal is well known in the art. Ceramic block filters have found wide acceptance for use in radio communication devices including high frequency devices such as pagers, cellular telephones and other signal processing apparatus.

Traditionally, most external surfaces of the dielectric ceramic block filters are coated with a metallic surface which serves as an electrical ground for the filter. The top and side surfaces of the filter are often used as a printing or patterning surface and often contain a printed metallized pattern which is required in order to achieve the desired frequency response for the filter. However, as the size of the component decreases, printed patterns require a more fine-lined geometry and become increasingly difficult to apply. Another possibility is to chamfer the area around the through-holes on the top or the bottom surfaces of the filter as another method of achieving the desired electrical response. In this instance, a problem can arise as the components become smaller. If the walls around the chamfer become too thin and fragile, large scale manufacturing is not a viable alternative. The significant point, however, is the fact that the processing of the top and/or bottom surfaces of the filter is often an integral step in getting the appropriate electrical filter response.

A trend in the industry is toward components which are smaller in size, require less volume, less weight, and take up less surface area on a printed circuit board, while also keeping a low profile above the surface of the printed circuit board. As such, designers of ceramic block filters are being asked to provide filters with smaller dimensions which exhibit desirable electrical properties. Since the top and bottom surfaces of the ceramic filter are often the surfaces of the block with least surface area, designers are being forced to place intricate electrical patterns and chamfers on a top surface with less and less surface area. Additionally, a shielding structure is also sometimes required in order to protect the filter from stray electromagnetic signals both on the board and emanating from the filter itself. The design and mounting of these shields often results in problems with co-planarity, access to the cells and adhesion among other things.

A ceramic block filter design which provides an increased printing area on the top surface of the ceramic block filter, while allowing many other dimensions of the ceramic block filter to decrease (in response to the demands of the electronics industry), while also providing for some novel shielding configurations, would be considered an improvement over the art.

DETAILED DESCRIPTION OF THE PREFERRED EMBODIMENT

Figure 1:
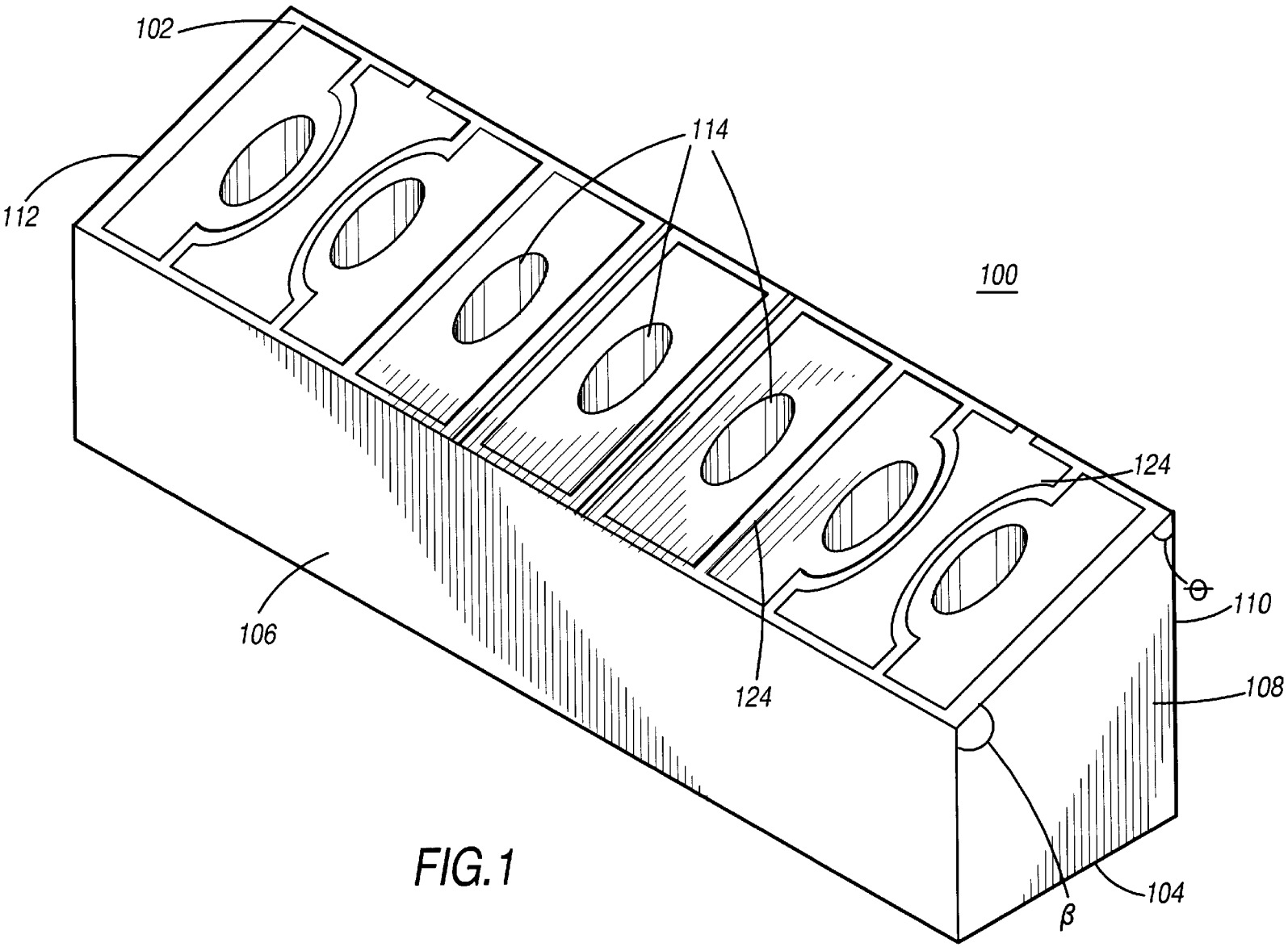
FIG. 1 shows a perspective view of the ceramic filter with a beveled surface, in accordance with the present invention.

FIG. 1 shows a perspective view of a ceramic filter with a beveled surface in accordance with the present invention. It is notable that the beveled-top surface allows the overall skyline height of the filter over a board, to be decreased (through a smaller sized component), while the overall printing area on the top surface of the block may remain constant or possibly even be increased. This allows smaller filter blocks to be produced in large volumes without facing the difficulty of applying an intricate pattern to an increasingly smaller top surface. In fact, by incorporating the ceramic filter with a beveled surface, there is a savings of both time and cost which is realized due to the ease of manufacturing, a simpler design more suited to mass production, and the ease of tooling associated with this design. Another advantage of the top-beveled surface is that the increased surface area allows for the easy placement of discrete components directly on the top-beveled surface, as shown as item 218 in FIG. 2.

FIG. 1 shows a ceramic block filter 100 having a top-beveled surface 102, a bottom surface 104, and four side surfaces 106, 108, 110, and 112. A plurality of through-holes 114 run from the top surface 102 to the bottom surface 104. A metallization layer coat most of the exterior surfaces of the filter as well as the interior surfaces of the through holes. The top surface 102 is beveled at an acute angle theta ($\Theta$) with respect to a side surface of the filter 100. More particularly, as shown in FIG. 1, the top surface 102 is beveled at an acute angle theta ($\Theta$) with respect to the rear side surface 110 of the filter 100. Correspondingly, the beveled-top surface 102 also creates an obtuse angle beta ($\beta$) with respect to the front side surface 106 of the filter 100. A printed pattern 124 is provided on the top surface 102 of the block.

As is shown in FIG. 1, the general shape of this filter can best be described as a prismatoid, or a polyhedron having all vertices lying in one of two parallel planes. In layman terminology, from a side view, these filters will look like right triangles (the beveled surface) sitting atop rectangular blocks. Similarly, when both the top and the bottom surfaces are beveled (see FIG. 7), from a side view, these filters will look like parallelograms. As the angle theta ($\Theta$), shown in FIG. 2A, varies, the overall geometric shape will remain substantially the same, yet specific embodiments may appear quite different. From a processing perspective, the bevel can be easily formed during any one of many manufacturing steps required to produce the filter, including possibly a lapping, dicing, pressing, or grinding operation.

The tooling and fixturing aspects of the re-design of traditional rectangular ceramic block filters to these ceramic block filters 100 with a beveled top surface 102 is an important and advantageous feature of the present invention. In simple terms, the re-design of the filter requires just a minimal amount of retooling. The only significant change to the manufacturing process involves rotating the fixtures which hold the ceramic block filter 100 in such a manner as to assure that the beveled surface 102 is substantially horizontal when the printed pattern is being applied or other top surface processing steps occur. Aside from this minor processing variation, all other processing steps remain substantially unchanged.

An important decision for a designer of these filters involves the extent to which the top surface 102 should be beveled. For example, by beveling the top surface by even the smallest amount, the overall area of the top surface will be increased. On the other hand, if the bevel on the top surface is too great or if the top surface of the filter becomes too steep, a host of other problems will appear, including a ceramic block filter which lacks structural integrity, cannot be easily handled, has too much material removed so as to cause electrical degradation, and the increased metallization cost associated with having a filter with greater surface area.

The present invention avoids these problems by setting maximum and minimum values of theta (Θ) which, in turn, dictate maximum and minimum values for the increase in surface area of the filter. In the broadest sense, the surface of any filter may be beveled to the extent that the dielectric block maintains its structural integrity. In a preferred embodiment, the acute angle theta (Θ) is sufficiently large so as to provide at least a nominally increased top surface area and the acute angle is sufficiently small such that the top and the bottom surfaces of the filter are not connected.

In a more preferred embodiment, the acute angle theta (Θ) will range from about 20 degrees to about 70 degrees with respect to a rear side surface. This range of values is realistically suited to the manufacturing processes involved in this technology. If the angle is less than 20 degrees, there is really not a sufficient gain in surface area to justify the retooling and re-fixturing required. Alternatively, if the acute angle is greater than 70 degrees, the beveled top surface is so steep that it creates other processing problems which have been described above.

In a more preferred embodiment, the acute angle theta (Θ) will range from about 40 degrees to about 50 degrees with respect to a rear side surface. This range is best suited for mass production of dielectric ceramic block filters. Additionally, when the acute angle theta (Θ) is in this desirable range, there is greatest access to the individual cells on the top surface of the filter. Access to the cells is important for a tuning step which occurs later in the manufacturing process. The present invention actually offers an improvement over the prior art purely rectangularly shaped block filters in that by beveling the top surface of the filter, improved access to the tuning centers on the top of the block is achieved. Creating an acute angle theta (Θ) which is in this range also leads to simplicity of design and ease of manufacture.

Figures 2A, 2B:
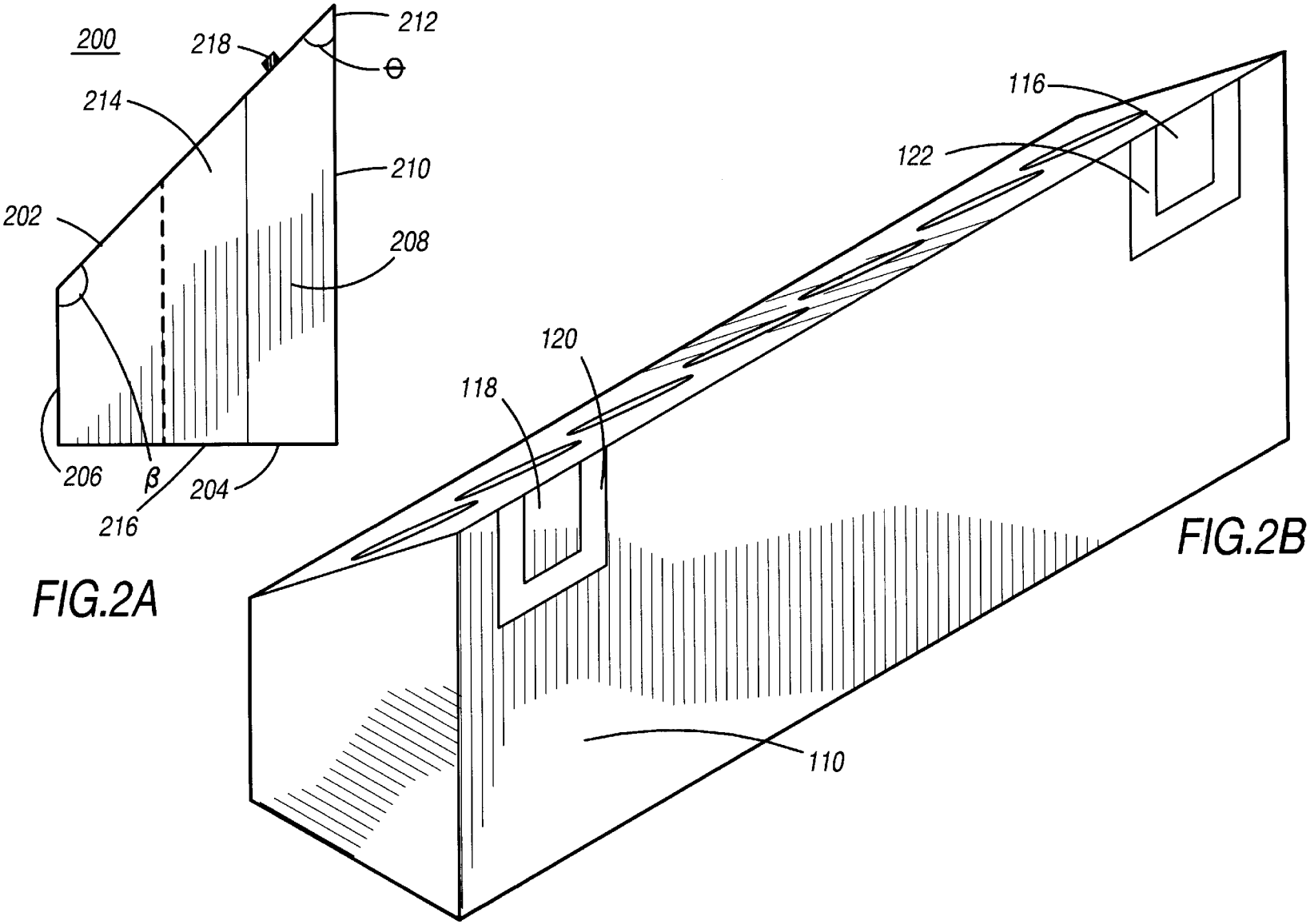
FIG. 2A shows a side view of the filter of FIG. 1, showing a top surface at an acute angle with respect to a rear surface, in accordance with the present invention.
FIG. 2B shows another perspective view of the filter of FIG. 1, which shows the electrical input and output pads, in accordance with the present invention.

FIG. 2A shows a side view of the filter of FIG.1 in accordance with the present invention. FIG. 2A shows a two dimensional view of a filter 200 having a top 202, bottom 204, and four side surfaces 206, 208, 210 and 212. Through-holes 214 run from the top to the bottom surface of the filter. A metallization layer 216, which covers substantially all surfaces of the filter is also provided. From this view, the beveling of the top surface with respect to another side surface of the filter at an angle of theta (Θ) is clearly shown. The placement of a discrete component on a dielectric ceramic block is also shown as item 218 in FIG. 2A. Correspondingly, the beveled top surface 202 also creates an obtuse angle beta (β) with respect to the front side surface 206 of the filter 200. Acute angle theta (Θ) and obtuse angle beta (β) are substantially complementary.

FIG. 2B shows another perspective view of the filter of FIG. 1, which shows the electrical input and output pads in accordance with the present invention. In FIG. 2B, the coupling means includes a pair of input and output pads 116, 118 respectively which are surrounded by corresponding areas of unmetallized dielectric 120, 122. In this embodiment, the input and output pads are placed on the side surface 110 of the dielectric ceramic filter block.

When the top surface is beveled to achieve an improved and increased printing surface, it must then follow that the top surface of the filter will have a corresponding apex. In a preferred embodiment, the apex will be along the edge where the top surface of the filter meets the rear surface of the dielectric block which contains input and output pads. Although the present invention does contemplate a situation where the bevel slopes toward the side input-output surface of the block, that configuration may present both shielding and mounting challenges. Similarly, the present invention also contemplates an embodiment where the top of the block has two beveled surfaces creating an apex in the center region of the block, analogous to an isosceles triangle atop a rectangular block. This embodiment may present challenges, however, in manufacturing and is thus not the most preferred embodiment. Consequently, a preferred embodiment will have a front surface of the filter which has less surface area than the rear, surface mounted side of the filter.

The presence of an apex on the top surface of the filter has the potential to create problems during manufacturing and production, and also when the filter is eventually mounted on the printed circuit board. More specifically, a sharp edge of the apex, which will be sharper as the surface area on the top surface of the block is increased, is susceptible to chipping, cracking, difficulty in metallizing and grounding, as well as other more subtle problems. For this reason, another feature of the present invention is a ceramic filter with an improved beveled surface that has a blunted, rounded or smooth apex. The apex can be easily blunted during the processing of the filter in a lapping, dicing, pressing, or grinding operation. Again, the purpose of having a blunt apex would be to improve the manufacturability of the filter, facilitate mass production, make the filter easier to handle, and minimize the chances of chipping the filter during production. An embodiment of the present invention in which the apex is blunted is provided in FIG. 5.

Figure 7:
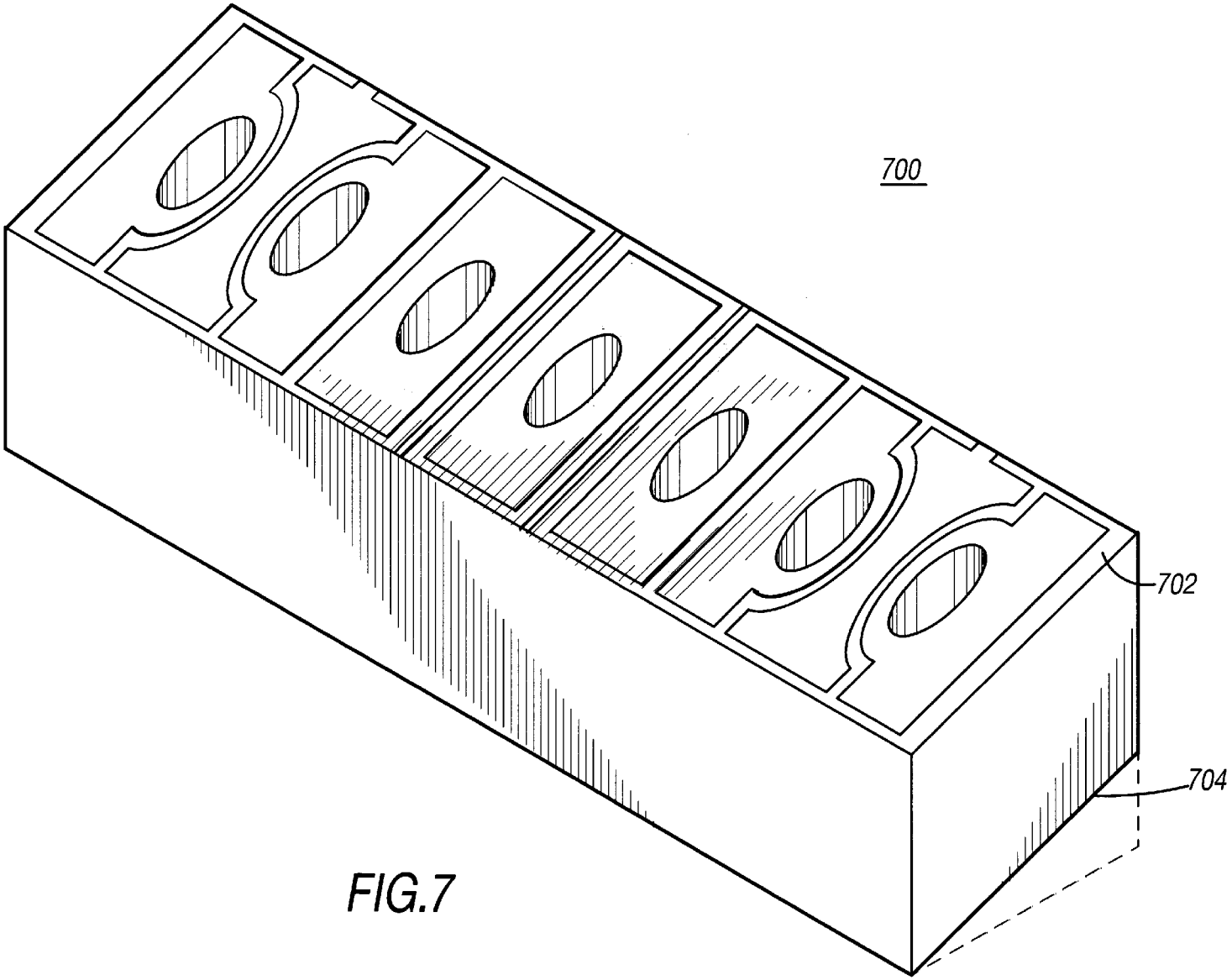
FIG. 7 shows another embodiment of the present invention in which both the top and the bottom surfaces of the filter contain beveled surfaces.

The filter shown in FIG. 7 describes an embodiment in which both the top and the bottom surfaces are beveled creating a filter which has a profile of a parallelogram. In FIG. 7, a filter 700 is provided in which both the top surface 702 and the bottom surface 704 are beveled at an angle theta (Θ) to create a filter with two beveled surfaces at opposite ends of the dielectric block. In this embodiment, both the top and bottom surfaces are substantially parallel, however, due to manufacturing issues relating to the pressing and firing operations, these filter surfaces may not be exactly parallel when the filter is completed. Preferably, the filter should, however, meet the industry standards for specifications relating to co-planarity and parallelism.

Ceramic block filters often require a metallic shield in the region of the top surface of the block. This is often necessary to improve the electrical performance of the filter and also to protect the filter or circuitry external to the filter from electromagnetic interference (EMI) and other sources of radiation. Consequently, metallic shields are often attached to filters of this type. The shielding requirements for ceramic block filters often result in filter designs which must be drastically changed to accommodate the shield. Even then, shielding often can become a major issue as problems with shield attachment, spacing, adhesion and co-planarity can occur. By providing a ceramic block filter with an improved beveled printing surface, a novel solution to the shielding problem is presented as a result of the beveled top surface.

Figure 3:
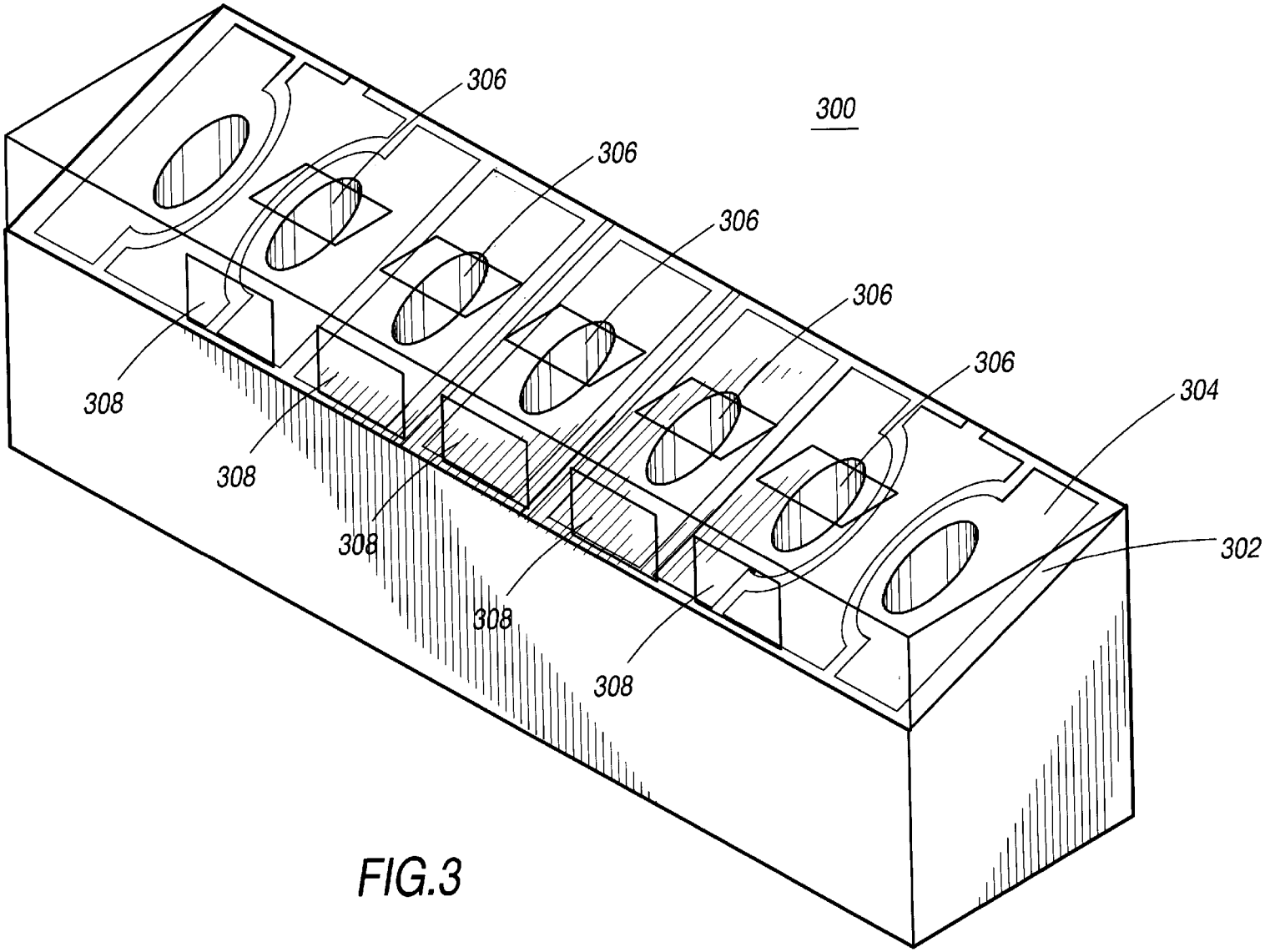
FIG. 3 shows a perspective view of the filter of FIG. 1 having a shield attached to the top surface, in accordance with the present invention.

FIG. 3 shows a view of the filter of FIG. 1 having a shield 304 attached to the top surface. The shield on this filter is attached in a manner that actually avoids the problem of co-planarity because the shield itself forms a right angle on top of the beveled surface. This shield is easily attached to the front of the filter and forms a protective covering around the top of the filter.

Another design option would be to place a notch in the shield to provide access for the tuning of the individual resonator cells of the filter. This is also shown in FIG. 3. Of course, the exact design of each individual shield would vary according to the design of each filter, but the concept of placing an access notch in either the shield or the block or on both the shield and the block could be applied to any filter of this type which requires a shield.

In FIG. 3, a filter 300 having a beveled top surface 302 with a custom-fitted shield 304 is provided. The shield is complementarily configured to fit over the top surface of the shield and protect the filter from harmful interference. In this embodiment, top and side notches 306 and 308 are designed into the shield to provide access to the tuning centers of the individual resonator cells. The shield, which is mechanically designed to fit the filter may be soldered, bonded or attached in any appropriate manner to the metallized surface of the filter.

Figure 4:
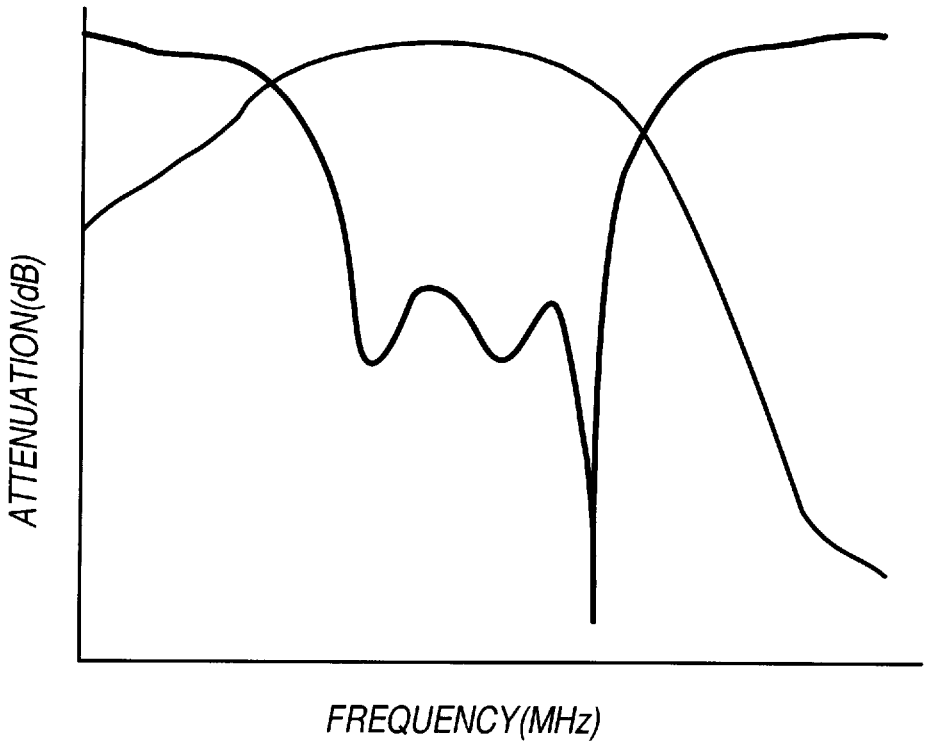
FIG. 4 shows a plot of the frequency response curve for a filter similar to that shown in FIG. 1, in accordance with the present invention.

FIG. 4 shows a plot of the frequency response curve for a filter similar to that shown in FIG. 1. More particularly, the proto-type filter had a theta (Θ) angle and beta (β) angle of 45°, did not have a shield, had seven oblong through-holes, and a primitive top metallization pattern which electrically acted much like the pattern shown in FIG. 1, but was not identical. Also, the proto-type filter was tuned by use of a small, drill-like device. From this frequency response curve, it can be seen that a dielectric block of ceramic, even after its top surface has been beveled, can provide a workable filter response capable of passing a desired frequency in an electrical signal and eliminating undesirable frequencies from an electrical signal. The graph in FIG. 4 shows the attenuation in decibels (dB) versus frequency in megahertz (MHz) for a ceramic block filter with a beveled top surface. The top curve shows a passband measured as frequency (MHz) and the lower curve shows insertion loss measured as attenuation (dB). These curves show that a desirable waveform response may be achieved by a ceramic filter with a beveled surface. This graph shows that this type of filter can be useful in a pager, cellular telephone, or other piece of electronic equipment that requires signal processing.

Figure 5:
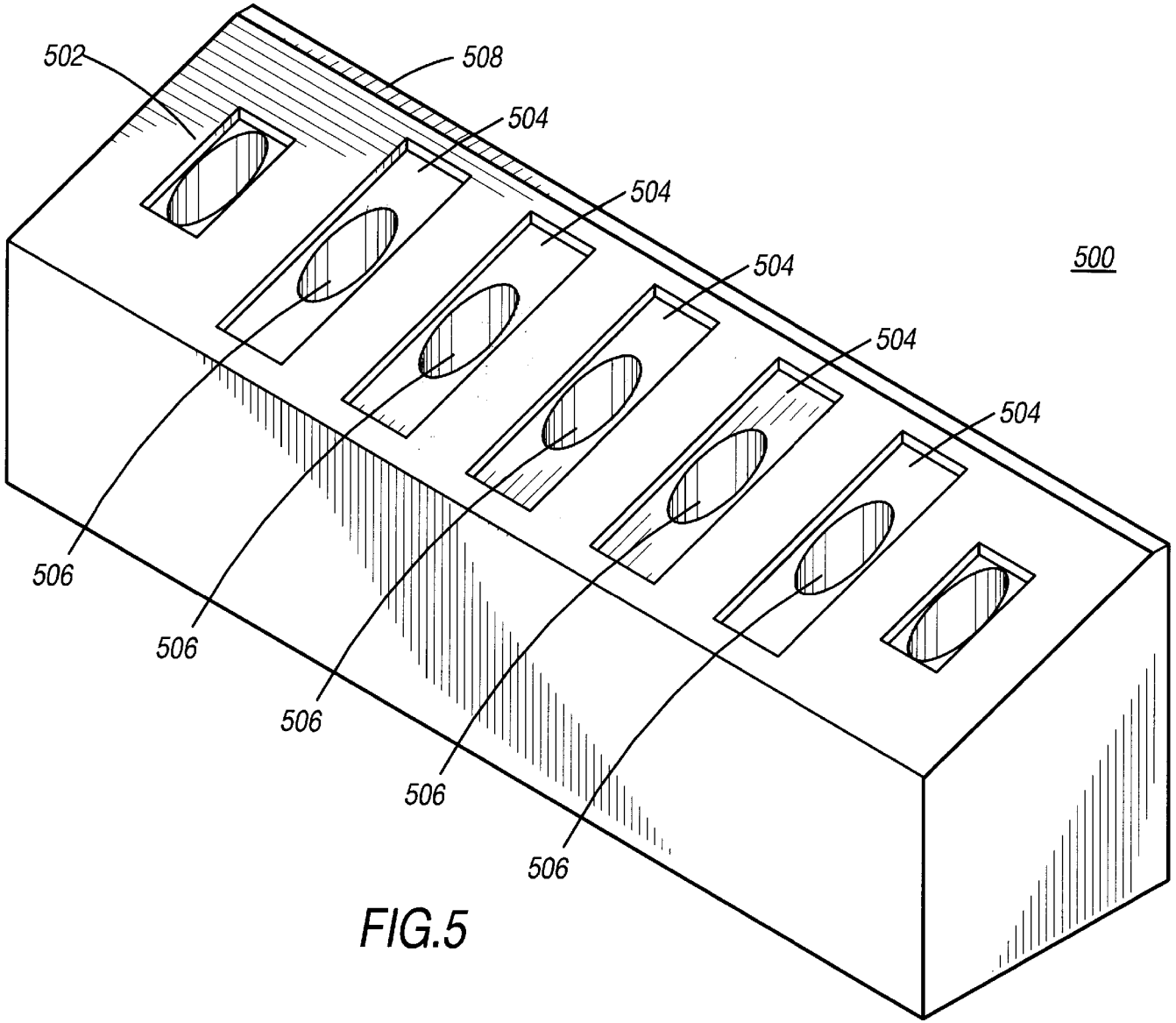
FIG. 5. shows a perspective view of another embodiment of the ceramic block filter in which the beveled surface has chamfers around the through-holes, in accordance with the present invention.
Figure 6:
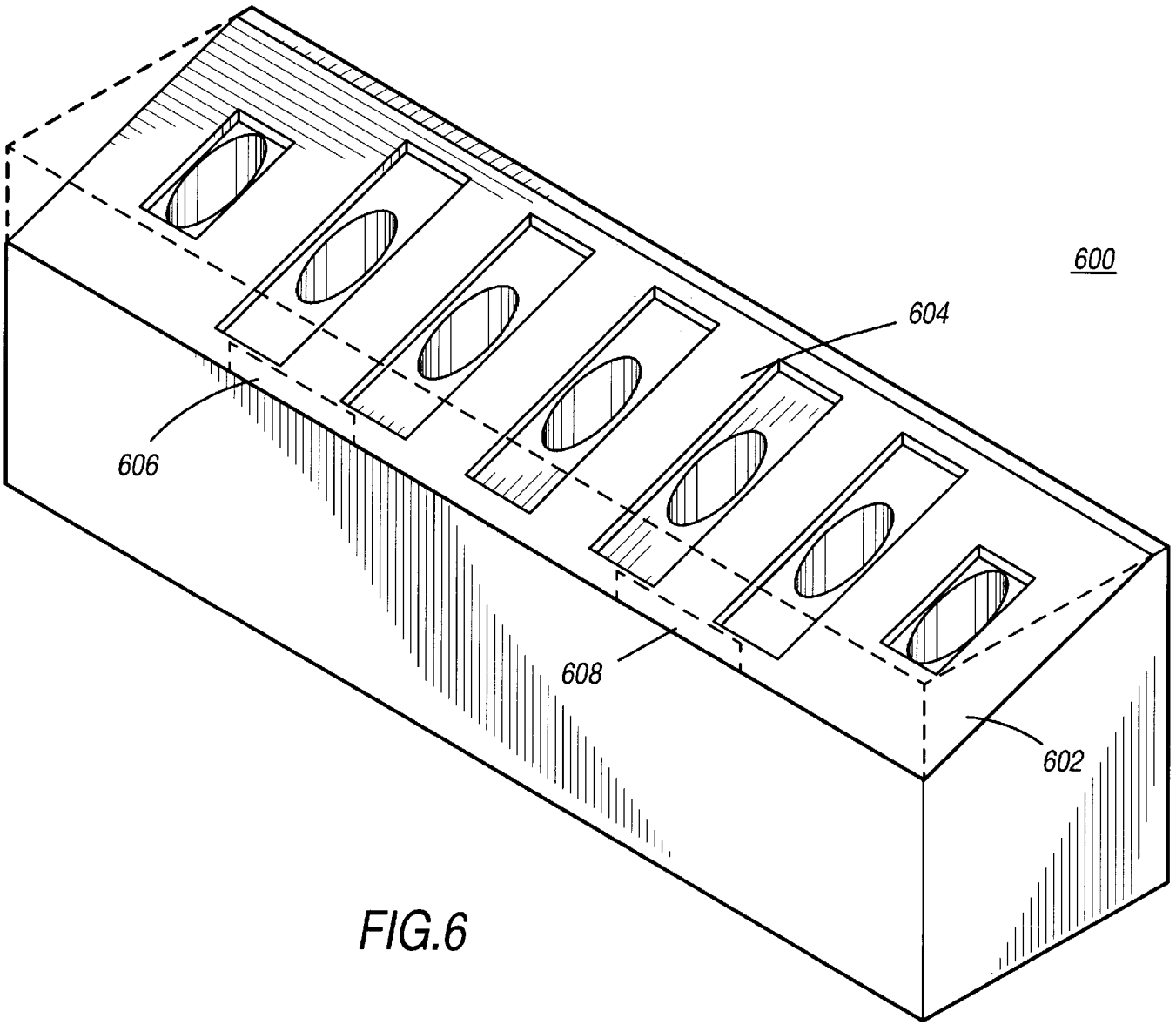
FIG. 6 shows a view of the filter of FIG. 5 having a shield attached to the top surface, in accordance with the present invention.

FIG. 5 shows another embodiment of the ceramic block filter in which the beveled printing surface is applied to a filter with chamfers around the through-holes. In FIG. 5, a filter 500 is provided in which the top beveled surface 502 has a series of chamfers 504 immediately surrounding each of the series of through-holes 506. In this embodiment of the present invention, the top surface is beveled in order to provide for a greater area in which to place chamfers 504 providing the designer with a greater degree of freedom. Similar to other embodiments of the present invention, the top surface 502 is beveled at an angle theta (Θ) with respect to a side surface of the filter. FIG. 6 shows a view of the filter of FIG. 5 having a shield attached to the top surface in accordance with the present invention. FIG. 6 shows a filter 600 having a top surface 602, and a shield 604 attached to the top surface. This figure shows a pair of notches 606, 608, designed into the shield. The purpose of these notches is to provide access to the individual resonator through-holes for tuning purposes. The novel shielding structure could apply equally to a printed or chamfered filter.

Although various embodiments of this invention have been shown and described, it should be understood that various modifications and substitutions, as well as rearrangements and combinations of the preceding embodiments can be made bythose skilled in the art, without departing from the novel spirit and scope of this invention.

What is claimed is:

1. A ceramic block filter, comprising:

a substantially rectangular block of ceramic material having a top surface, a bottom surface, a front surface, a rear surface and two side surfaces, and having a plurality of through-holes extending from the top to the bottom surfaces;

a metallization layer covering substantially all surfaces of the block and the through-holes, with the exception of a part of the top surface of the block being unmetallized;

the top surface is at an acute angle with respect to the rear surface and an obtuse angle with respect to the front surface, and the acute angle and the obtuse angle are substantially complementary angles; and an input pad and an output pad on the rear surface of the substantially rectangular block of ceramic material, the input pad and the output pad electrically isolated from the metallization layer.

2. The ceramic block filter of claim 1, wherein the top surface has an electrical pattern provided thereon.

3. The filter of claim 1, wherein the block comprises a substantially prismatoid shape.

4. The filter of claim 1, wherein the acute angle provides an apex which is substantially blunt.

5. The ceramic block filter of claim 1, wherein the acute angle is sufficiently large so as to provide at least a nominally increased top surface area on which an electrical pattern is provided thereon and the acute angle is sufficiently small such that the top and bottom surfaces of the filter are separated by the front surface.

6. The filter of claim 1, wherein the acute angle ranges from about 20 degrees to about 70 degrees with respect to the rear surface.

7. The filter of claim 1, wherein the acute angle ranges from the 40 degrees to about 50 degrees with respect to the rear surface.

8. The filter of claim 1, further comprising a shield connected to the top and the front surfacer of the filter.

9. A ceramic block filter, comprising:

a substantially rectangular block of ceramic material having a top surface, a bottom surface, a front surface, a rear surface and two side surfaces, and having a plurality of through-holes extending from the top to the bottom surfaces;

a metallization layer covering on substantially all surfaces of the block and the through-holes, with the exception of a part of the top surface of the block being unmetallized;

the top surface beveled at an acute angle in the range of about 40 degrees to about 50 degrees with respect to the rear surface and at an obtuse angle with respect to the front surface, and the acute angle and the obtuse angle having substantially complementary angles; and an electrical input and an output pad on the rear surface of the substantially rectangular block of ceramic material, the input pad and the output pad electrically isolated from the metallization layer.

10. The filter of claim 9, further comprising a shield connected to the top and the front surfaced of the filter.

11. A ceramic block filter, comprising:

a substantially rectangular block of ceramic material having a top surface, a bottom surface, a front surface, a rear surface and two side surfaces, and having a plurality of through-holes extending from the top to the bottom surfaces;

a metallization layer covering substantially all surfaces of the block and the through-holes, with the exception of a part of the top surface of the block being unmetallized;

the top surface includes a discrete component and is at an acute angle with respect to the rear surface and at an obtuse angle with respect to the front surface, and the acute angle and the obtuse angle are substantially complementary angles; and an input pad and an output pad on the rear surface of the substantially rectangular block of ceramic material, the input pad and the output pad electrically isolated from the metallization layer.

12. A ceramic block filter, comprising:

a substantially rectangular block of ceramic material having a top surface, a bottom surface, a front surface, a rear surface and two side surfaces, and having a plurality of through-holes extending from the top to the bottom surfaces;

a metallization layer covering substantially all surfaces of the block and the through-holes, with the exception of a part of the top surface of the block being unmetallized;

the top and the bottom surfaces are beveled at a respective acute angle with respect to a corresponding one of the front and rear surfaces; and an input pad and an output pad on the rear surface of the substantially rectangular block of ceramic material, the input pad and the output pad electrically isolated from the metallization layer.

13. A ceramic block filter, comprising:

a substantially rectangular block of ceramic material having a top surface, a bottom surface, a front surface, a rear surface and two side surfaces, and having a plurality of through-holes extending from the top to the bottom surfaces;

a metallization layer covering substantially all surfaces of the block and the through-holes, with the exception of a part of the top surface of the block being unmetallized;

the top surface having a plurality of chamfers surrounding the plurality of through-holes;

the top surface is at an acute angle with respect to the rear surface and an obtuse angle with respect to the front surface, and the acute angle and the obtuse angle having substantially complementary angles; and input-output pads on the rear surface of the substantially rectangular block of ceramic material, the input pad and the output pad electrically isolated from the metalization layer.

14. The filter of claim 13, wherein a substantially blunt apex is provided between the top and the rear surfaces, defining a substantially blunt interface.

15. The filter of claim 13, wherein both the top and the bottom surfaces are beveled at a respective acute angle with respect to a corresponding one of the front and rear surfaces of the filter.

16. The filter of claim 13, further comprising a shield connected to the top and the front surfaces of the filter.

* * * * *